United States Patent [19]

Bustin

[11] 4,353,497

[45] Oct. 12, 1982

[54] FREE-STANDING THERMOPLASTIC BAG CONSTRUCTION

[75] Inventor: Franz Bustin, Rochester, N.Y.

[73] Assignee: Mobil Oil Corporation, New York, N.Y.

[21] Appl. No.: 234,227

[22] Filed: Feb. 13, 1981

Related U.S. Application Data

[63] Continuation-in-part of Ser. No. 85,183, Oct. 15, 1979, abandoned.

[51] Int. Cl.[3] ..... B65D 33/02

[52] U.S. Cl. ..... 229/55; 229/61

[58] Field of Search ..... 229/55, 57, 58, 61

[56] References Cited

U.S. PATENT DOCUMENTS

| | | | |
|---|---|---|---|
| 448,142 | 3/1891 | Paige | 229/55 |
| 2,086,735 | 7/1937 | Neumiller | 229/57 |
| 2,533,554 | 12/1950 | Byerly | 229/55 |
| 2,538,920 | 1/1951 | Shumann | 229/55 |
| 3,380 ,646 | 4/1968 | Doyen et al. | 229/57 |
| 3,437,258 | 4/1969 | Kugler | 229/57 |
| 3,550,839 | 12/1970 | Clayton et al. | 229/55 |
| 3,738,565 | 6/1973 | Ackley et al. | 229/55 |
| 3,799,914 | 3/1974 | Schmit et al. | 229/61 |
| 3,829,007 | 8/1974 | Ellison | 229/55 |
| 4,041,851 | 8/1977 | Jentsch | 229/61 |

FOREIGN PATENT DOCUMENTS

| | | | |
|---|---|---|---|
| 1349543 | 12/1963 | France | 229/55 |

*Primary Examiner*—Stephen P. Garbe

*Attorney, Agent, or Firm*—Charles A. Huggett; Michael G. Gilman; James P. O'Sullivan, Sr.

[57] ABSTRACT

The present invention relates to thermoplastic bag constructions capable of standing in an open and erect position without the extraneous support means normally employed with such bags. The bag is characterized by having a bottom gusset and heat sealed side seams which form the lateral bag edges. The individual walls of the bottom gusset are sealed to the adjacent bag walls utilizing a plurality of spaced apart vertical heat seals which are arranged in a predetermined pattern whereby when the bag is open the bag bottom assumes an elliptical configuration and is self-supporting as a result of the stiffening effect of the vertical heat seals.

6 Claims, 8 Drawing Figures

BAG BOTTOM CONFIGURATIONS
FIG. 1
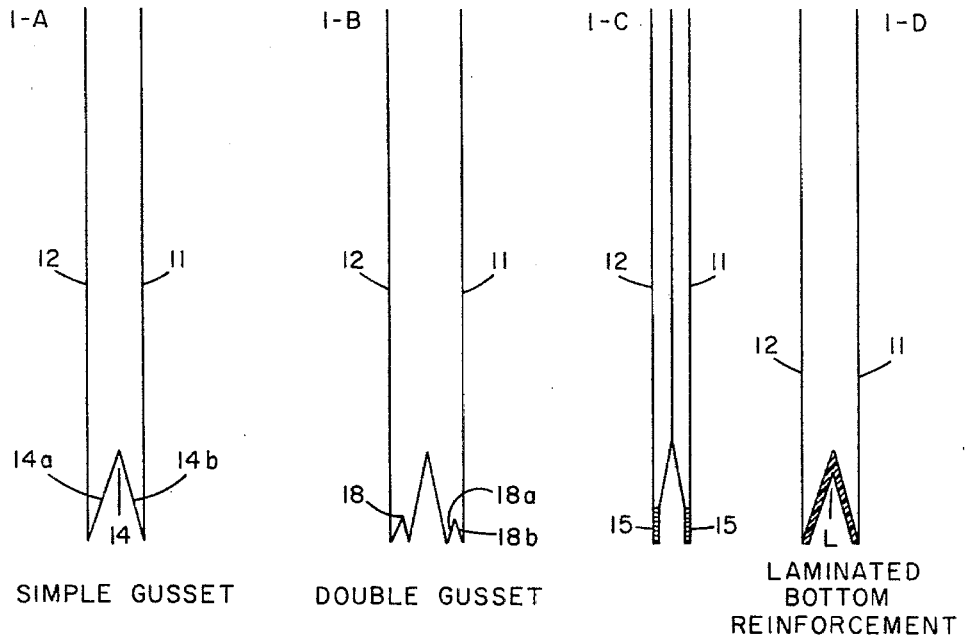
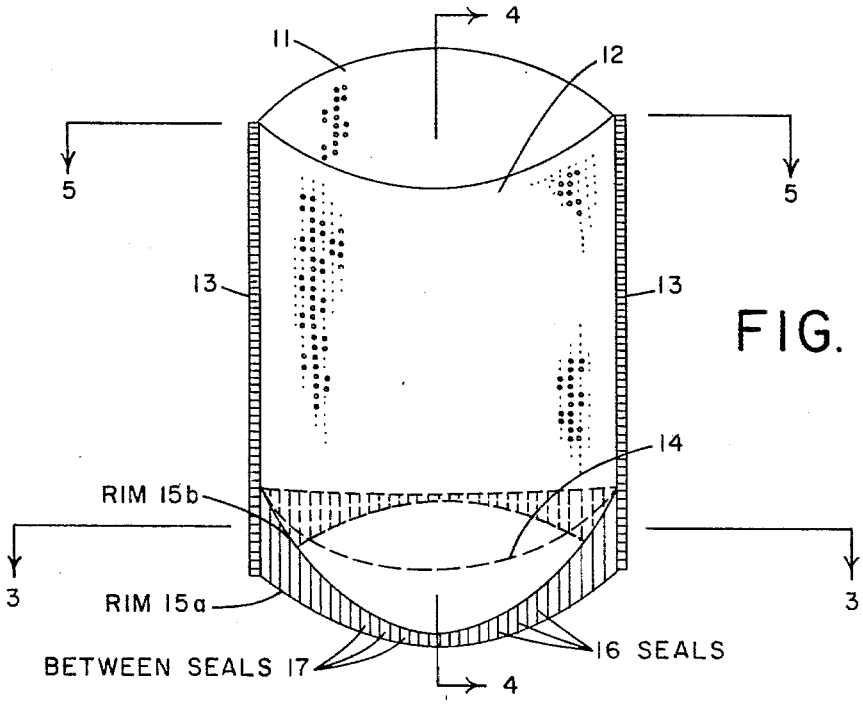
FIG. 2

FREE-STANDING THERMOPLASTIC BAG CONSTRUCTION

This application is a Continuation-in-Part of the copending application with serial number 85,183 filed on Oct. 15, 1979 and now abandoned.

BACKGROUND OF THE INVENTION

1. Field of the Invention

The present invention relates to thermoplastic bag constructions which are characterized by having a modified bottom gusset edge utilizing a plurality of spaced apart heat seals whereby when the bag is open the bag is self-supporting as a result of the stiffening effect of the vertical heat seals.

2. Description of the Prior Art

In the past, free-standing bag constructions have been characterized by having a rectangular base configuration such as the familiar kraft paper bag which, when opened, has a base which is formed from multiple overlapping layers of the bag which are usually adhesively secured together. Attempts have been made to structure thermoplastic film bags in a manner such that they too would be able to stand open and erect on a support surface. Such attempts have been generally unsatisfactory since the thin plastic material, being relatively limp, tends to crease and fold or fall over. Attempts to remedy this have included increasing the thickness of the material from which the bag is formed to thereby stiffen the bag wall. However, the attendant increase of resin material which thickening entails has made such bags uneconomical. U.S. Pat. No. 3,380,646 is illustrative of attempts made in the past to structure thermoplastic bags in order that they would be free-standing. Such prior art bags, however, have been unsatisfactory as a result of disadvantages which are inherent in their material of construction, namely, the resistance of thermoplastic film to permanent creasing and the lack of modulus or stiffness in comparison to paper or other typical bag materials, including aluminum foil and the like.

SUMMARY OF THE INVENTION

The present invention relates to thermoplastic bag structures which are adapted to remain in an upright position when open. The bag comprises a front wall and a rear wall which are joined together by heat sealed seams along the lateral edges of the bag wall. The upper edges of the bag walls constitute the bag mouth opening while the lower edges of the bag walls are joined together by a bottom gusset fold. A plurality of spaced apart vertical heat seal seams along the bottom edge of the bag join the front wall of the gusset to the front wall of the bag and another series of spaced apart vertical heat sealed seams join the rear wall of the gusset to the rear bag wall at its lower edge. The vertical heat sealed means are arranged so that they are in continuously decreasing height pattern from a position immediately adjacent to the heat sealed seam forming the bag edge to a point of minimum height at the central lower edge of the bag. Such an arrangement provides a generally elliptical shaped bottom wall when the bag is in an opened condition. The stiffening effect of the spaced apart vertical seals which form a corrugation-like configuration allows the bag to remain in an upright position in the absence of extraneous wall supporting means.

In particular embodiments of the present invention the thermoplastic from the bag is formed may be polyethylene film which has been continuously embossed whereby the embossed pattern is printed so that it is raised above the surface of the bag walls and serves to enhance the stiffening effect of the bottom corrugated areas formed by the spaced apart vertical heat seals. Additionally, the lower edges of the bag front and rear wall may be formed having their own individual gussets which are sealed together to provide a bag having a four-ply bottom rim which serves to further enhance the desirable stiffening characteristics provided by the spaced apart vertical heat seal seams.

DESCRIPTION OF THE DRAWINGS

FIGS. 1-A through 1-D are graphic representations of preforms of bag bottom configurations which may be employed to form the bag structures of the present invention.

FIG. 2 is a perspective view of the present bag structure in an open standing position.

DESCRIPTION OF SPECIFIC EMBODIMENTS

Figure 3:
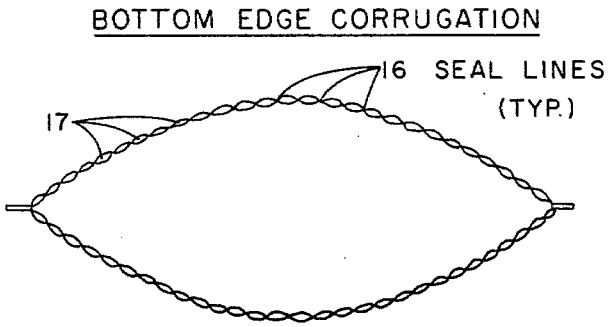
FIG. 3 is a cross-sectional view of the bag shown in FIG. 2 taken on line 3—3 of FIG. 2.
Figure 4:
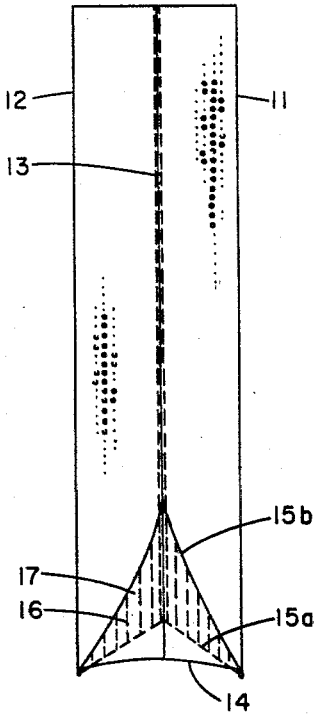
FIG. 4 is a cross-sectional view of the bag structure taken on line 4—4 of FIG. 2.
Figure 5:
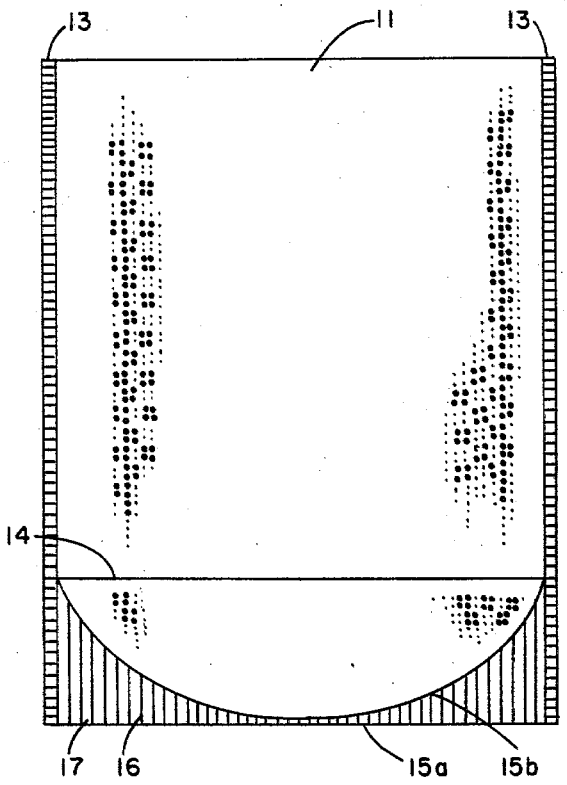
FIG. 5 is a side end view of the bag shown in FIG. 2 taken on line 5—5 of FIG. 2.

The bag structures of the present invention, and particularly as shown in FIG. 2 of the accompanying drawings, comprise a front wall 12 and a rear wall 11 which are joined together at opposed longitudinal edges by heat seal seams 13 which extend throughout the entire vertical height of the bag. Prior to forming the side seam seals 13, the bag is provided with a gusset reentrant fold 14 which eventually forms the bag bottom. The gusset consists of inwardly folded wall members 14A and 14B as shown in FIG. 1-A. An alternate gusset arrangement is shown in FIG. 1-B wherein the lower bag wall edges are provided with individual gusset folds 18 comprising gusset walls 18*a* and 18*b* in addition to the central gusset 14. When such a triple gusset configuration is employed, gussets 18 are sealed together to form a four-ply bag bottom rim 15*a* as shown in FIG. 1-C. Alternatively, the single bottom gusset arrangement shown in FIG. 1-A may be reinforced as shown in FIG. 1-D and the bottom of the bag stiffened by laminating another thermoplastic material L to the bag bottom. Individual heat seal seams 16 which are spaced apart at predetermined distances 17 are employed to secure portions of gusset walls 14*a* and 14*b* to the lower portion of the bag front and rear walls 11 and 12. The heat seal seams 16, as more clearly shown in FIGS. 2 and 3, are characterized by having a descending height gradient pattern from the side seal seams 13 and approaching the central portion of the bag bottom, where these seams extend upwardly from bottom rim 15 to a height optionally defined by heat seal 15*b*. As more clearly shown in FIG. 3, the height gradient of seals 16 causes the bag bottom gusset 14 to assume a generally elliptical configuration when the bag is opened. As is also shown in FIG. 3, the unsealed areas 17 which are bounded by seals 16 causes the bottom portions of the bag walls 11 and 12 to assume a generally corrugated shape which imparts a stiffening effect to the bag bottom resulting in the bag being able to stand in an erect position as shown in FIG. 2, absent any extraneous elements.

The embodiment of the present invention which employs the triple gusset reentant folds, illustrated in FIG. 1-B, results in a bag configuration wherein the base of the elliptical shaped rim, which forms the bag bottom, is constituted by a four-ply film thickness after the walls 18*a* and 18*b* of the gusset 18 have been sealed together in the previously described manner with the lower portions of gusset walls 14*a* and 14*b*; and the lower extremities of bag walls 11 and 12 immediately adjacent to gussets 18. Such a four-ply thickness of the bottom rim enhances the stiffening effect provided by the corrugation heat seams 16 hereinabove described, thereby increasing the bag's stability when it is in an open and erect position.

Although it has been found that the spacing between adjacent vertical seal lines 16, i.e., unsealed area width 17, may vary widely, such distances are usually dependent on the size and guage of the individual bag being constructed. For example, a 1.0 mil bag with spacing 17 having a width of anywhere from 0.25 inch up to about 0.5 inch is quite satisfactory. Conversely, although bags fabricated from thinner thermoplastics, such as, for example, 0.4 mil thickness, have been satisfactorily fabricated with seal spacings of about 0.25 up to about 0.5 inch, narrower spacing for thinner materials appears more desirable, such spacing between seals being on the order of about ⅛ or 3/16 inch. It is also noted that, although the vertical seals 16 in the accompanying drawings are approximately uniformly spaced, nonuniform spacing of seals 16 in an advantage in areas which are immediately adjacent to the vertical side seals 13. This would reduce bag heating during manufacture and consequently permit faster production cycles.

Although the height of seals 16 is not considered a critical feature of the present invention, it should be pointed out that it is preferred to have vertical seals 16 across the whole length of bottom rim 15.

To further add to the stiffness of the thin thermo-plastic material, the bag walls 11 and 12 are continuously embossed thus improving the capability of the bag wall to support itself.

The thermoplastic polyolefin material can be a blend of several polyethylenes or a single component of polyethylene homopolymers or copolymers. For example, it was found that high density polyethylenes, with densities higher than 0.940 g/cc, are appropriate for the use in the present invention. Samples using DuPont's 7810 and 7820 high density polyethylene copolymers were found to satisfy the conditions required in this invention. The above are only examples of many appropriate films that can be applied in the present invention.

It is to be understood that the foregoing description is merely illustrative of preferred embodiments of the invention, of which many variations may be made by those skilled in the art within the scope of the following claims without departing from the spirit thereof.

What is claimed is:

1. A bag structure of thin thermoplastic material adapted to remain in an upright position when opened comprising front and rear bag walls, an open mouth at the upper edge of said walls, heat seal seams joining said bag walls together along longitudinal edges, and at least one bottom gusset fold forming a bag bottom wall said gusset fold having front and rear gusset walls which are sealed to the adjacent bag walls utilizing a plurality of spaced apart vertical heat seals which extend upwardly from bottom edges of the bag walls and respective gusset walls in a predetermined pattern wherein said vertical seals are arranged in order of descending height from each of said longitudinal bag wall edges toward the central portion of said gusset fold, whereby when the bag is open the bag is self supporting as a result of the stiffening effect of the vertical heat seals.

2. A thermoplastic bag in accordance with claim 1 wherein the length of said vertical heat seal seams is defined by a heat sealed seam extending across the bag bottom where said seam assumes a generally arced configuration.

3. A thermoplastic structure in accordance with claim 1 wherein said bag walls are continuously embossed thus adding stiffness to the thin thermoplastic material.

4. A thermoplastic bag structure in accordance with claim 1 wherein the bottom edges of said front and rear walls contain gusset folds which folds have been heat sealed to form a four-ply bottom bag edge.

5. A thermoplastic bag structure in accordance with claim 1 wherein said bag bottom gusset is characterized by having laminated to the exterior surface thereof a thermoplastic reinforcing layer.

6. A thermoplastic bag structure in accordance with claim 1 which is fabricated from high density polyethylene film.

* * * * *